US007236127B2

(12) United States Patent
Vaskelainen et al.

(10) Patent No.: US 7,236,127 B2
(45) Date of Patent: Jun. 26, 2007

(54) CONTROL OF RADIATION PATTERN IN WIRELESS TELECOMMUNICATIONS SYSTEM

(75) Inventors: Leo Vaskelainen, Helsinki (FI); Kalevi Laukkanen, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/210,741

(22) Filed: Aug. 25, 2005

(65) Prior Publication Data

US 2006/0267839 A1 Nov. 30, 2006

(30) Foreign Application Priority Data

May 24, 2005 (FI) ..... 20055245

(51) Int. Cl.
*H01Q 3/26* (2006.01)

(52) U.S. Cl. ..... 342/372; 342/368

(58) Field of Classification Search ..... 342/368, 342/369, 372, 373; 343/853, 893
See application file for complete search history.

(56) References Cited

U.S. PATENT DOCUMENTS 4,280,128 A * 7/1981 Masak ..... 342/380
5,940,029 A * 8/1999 Ninomiya et al. ..... 342/372
6,295,026 B1 * 9/2001 Chen et al. ..... 342/368
6,320,540 B1 * 11/2001 Meredith ..... 342/377
6,897,829 B2 * 5/2005 Oliver et al. ..... 343/893

* cited by examiner

*Primary Examiner*—Dao L. Phan
(74) *Attorney, Agent, or Firm*—Squire, Sanders & Dempsey L.L.P.

(57) ABSTRACT

The invention relates to controlling of characteristics of radiation patterns in wireless telecommunications system, where radiation patterns are provided by antenna arrays, each antenna array comprising at least two independent antenna units, each antenna unit being associated with an antenna-unit-specific antenna signal. A control circuit for controlling the characteristics of radiation patterns comprises an antenna signal amplitude adjuster for adjusting a relative amplitude of at least two antenna-unit-specific antenna signals as a function of a phase shift between at least two radio frequency signals inputted into the antenna signal amplitude adjuster. The circuit further comprises an adjustable phase shifter for adjusting the phase shift between the at least two radio frequency signals inputted into the antenna signal amplitude adjuster.

25 Claims, 4 Drawing Sheets

CONTROL OF RADIATION PATTERN IN WIRELESS TELECOMMUNICATIONS SYSTEM

FIELD

The invention relates to a circuit, antenna system, base station, and method for controlling a characteristic of a radiation pattern provided by an antenna array of a base station of a wireless telecommunications system, and to a base station of a wireless telecommunications system.

BACKGROUND

A great challenge in wireless telecommunications is to provide spatial allocation of radiation power associated with radio transmission from base stations in directions where information transfer capacity is required and to reduce radio transmission from directions where no radio transmission is needed or the radio transmission may be non-beneficial. Spatial allocation involves directing radiation patterns in desired directions and controlling characteristics, such as shape, of the radiation patterns. Spatial allocation is usually enabled by controllable radiation patterns, which are typically provided by antenna arrays that comprise a plurality of independent antenna units.

Several mechanical means for controlling the characteristics of a radiation pattern provided by antenna arrays can be considered. The antenna arrays may be equipped with parasitic patches in the front or in the sides of patch elements or the shape of reflector in the antenna arrays may be changed. In these solutions, however, large mechanical movements of antenna parts are needed to control the characteristics of the radiation pattern. Furthermore, the impedance and/or the bandwidth of the antenna units may change as a result of changing the physical characteristics of the antenna arrays.

Therefore, it is useful to consider other techniques for controlling the characteristics of radiation patterns provided by an antenna array.

BRIEF DESCRIPTION OF THE INVENTION

An object of the invention is to provide an improved circuit, antenna system, base station and method. According to a first aspect of the invention, there is provided a circuit for controlling a characteristic of a radiation pattern provided by an antenna array of a base station of a wireless telecommunications system, where the antenna array comprises at least two independent antenna units, each antenna unit being associated with an antenna-unit-specific antenna signal, wherein the circuit comprises: an antenna signal amplitude adjuster for adjusting a relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster.

According to a second aspect of the invention, there is provided an antenna system of a base station of a wireless telecommunications system, comprising: an antenna array for providing a radiation pattern, the antenna array comprising at least two independent antenna units, each antenna unit being associated with an antenna-unit-specific antenna signal, wherein the antenna system further comprises: an antenna signal amplitude adjuster for adjusting relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster.

According to a third aspect of the invention, there is provided a base station of a wireless telecommunications system, comprising: an antenna array for providing a radiation pattern, the antenna array comprising at least two independent antenna units, each antenna unit being associated with an antenna-unit-specific antenna signal, the base station further comprising: an antenna signal amplitude adjuster for adjusting relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster.

According to another aspect of the invention, there is provided a method of controlling a characteristic of a radiation pattern provided by an antenna array of a base station of a wireless telecommunications system, where the antenna array comprises at least two independent antenna units, each antenna unit being associated with an antenna-unit-specific antenna signal, the method comprising: adjusting the phase shift between at least two radio frequency signals; and adjusting the relative amplitude of at least two antenna-unit-specific antenna signals as a function of the phase shift between the at least two radio frequency signals.

The invention provides several advantages.

In an embodiment, the invention enables a flexible control mechanism for controlling the characteristics of the radiation pattern without the requirement of altering the mechanical characteristics of the antenna array and the resulting degradation of the impedance match in the antenna array.

LIST OF DRAWINGS

In the following, the invention will be described in greater detail with reference to the embodiments and the accompanying drawings, in which FIG. 1 shows an example of a structure of a wireless telecommunications system;

DESCRIPTION OF EMBODIMENTS

Figure 1:
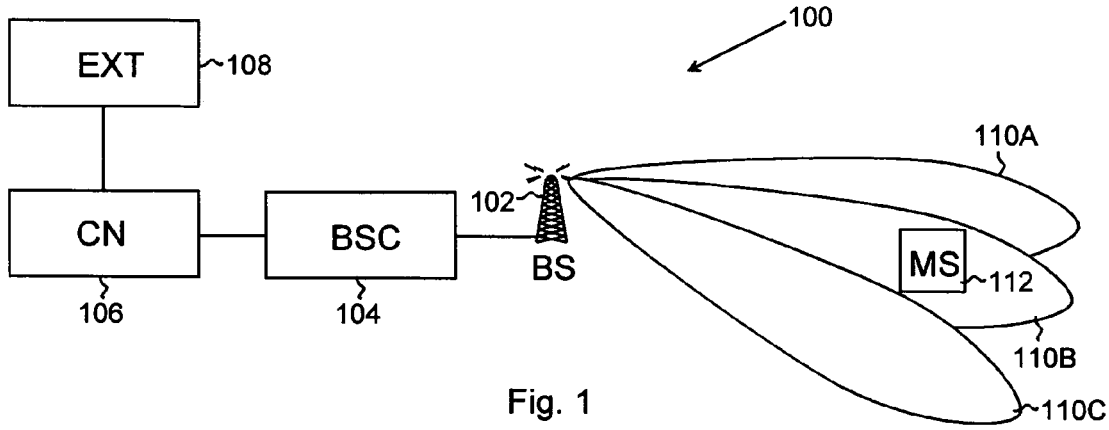

FIG. 1 illustrates an example of a structure of a wireless telecommunication system 100 to which the invention may be applied.

The wireless telecommunications system 100 is based on, for example, a GSM (Global System for Mobile Communications) radio access technology or WCDMA (Wideband Code Division Multiple Access) technology, without restricting the solution to the referred radio access technologies. The structure and function of wireless telecommunications systems are known to a person skilled in the art.

In the example shown in FIG. 1, the network elements are presented in terms of GSM terminology, without restricting embodiments of the invention to a GSM system.

The wireless telecommunication system 100 comprises a core network (CN) 106, which provides terrestrial switching network elements in the wireless telecommunications system 100.

A core network 106 is connected to a radio access network comprising at least one base station controller (BSC) 104 and a base station (BS) 102 controlled by the base station controller 104. The base station controller 104 exemplifies a network element, such as a radio network controller (RNC), which acts as an interface between the core network 106 and the radio access network.

The core network 106 may further be connected to external networks 108, such as the Internet.

The base station 102 exemplifies a network element implementing a radio interface between the radio access network and a mobile station 112 by means of a radiation pattern 110A, 110B, 110C. The base station 102 may also be referred to as a base transceiver station and/or node B. The invention is not, however, restricted to the presented structure of the wireless system 100, but can be applied to any wireless telecommunications system where the control of the radiation pattern 110A to 110C is required.

The mobile station (MS) 112 provides a user with access to the infrastructure of the wireless telecommunication system 100. The mobile station 112 may comprise conventional components, including wireless modems, processors with software, memory, a user interface, and a display. The structure and functions of the mobile station 112 are known to a person skilled in the art, and thus will not be described in detail.

Figure 2:
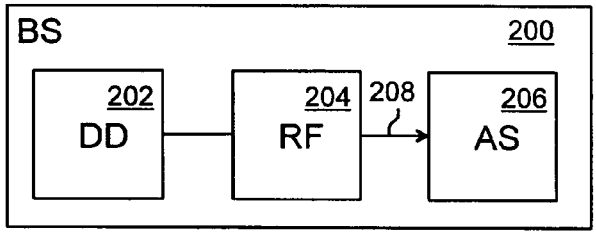
FIG. 2 shows an example of a structure of a base station.

With reference to FIG. 2, examine an example of a base station 200 to which embodiments of the invention can be applied. The base station 200 comprises a digital domain (DD) 202, a radio frequency unit (RF) 204 and an antenna system (AS) 206.

The digital domain 202 comprises means, such as digital processors, switches and memory, for processing digital telecommunication signals and control signals. The structure of the digital domain 202 is known to a person skilled in the art and will be described only when relevant to the present solution.

The radio frequency unit 204 converts digital signals received from the digital domain and converts the digital signals to at least one radio frequency signal 208, which is fed into the antenna system 206. The radio frequency unit 204 may include digital-to-analogue converters, up-converters, amplifiers and filters.

Figure 3:
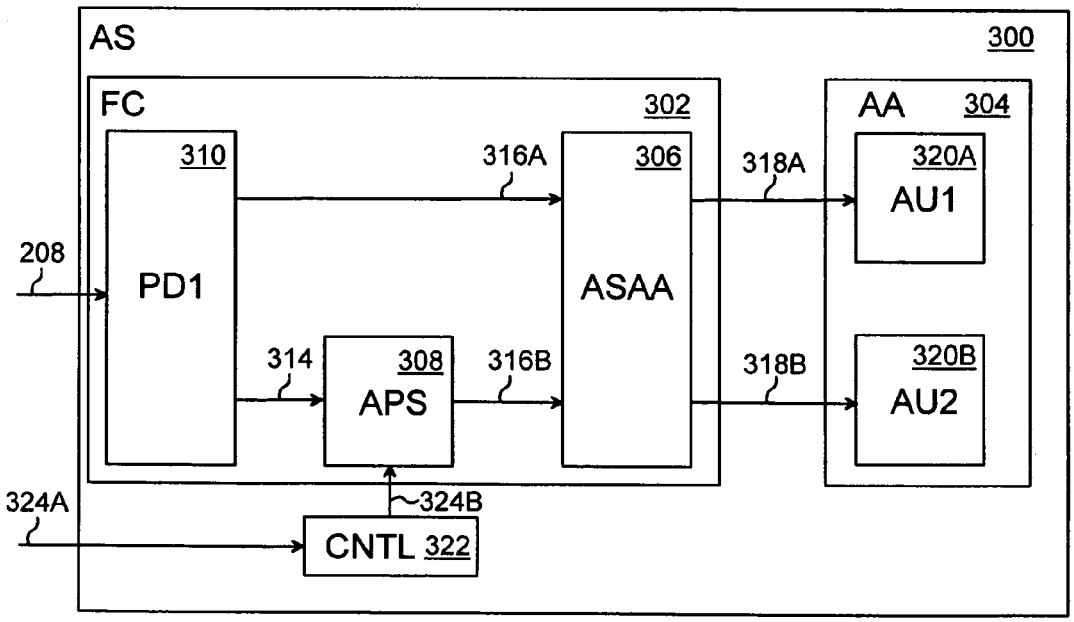
FIG. 3 shows an example of a structure of an antenna system according to an embodiment of the invention.

With reference to FIG. 3, a antenna system 300 includes a feeding circuit (FC) 302 and an antenna array (AA) 304 connected to the feeding circuit 302.

The antenna array 304 comprises at least two independent antenna units (AU1, AU2) 320A, 320B, each of which being associated with an antenna-unit-specific antenna signal 318A, 318B.

The independent antenna units 320A, 320B are typically electrically isolated from each other, thus being capable of providing a mutually independent contribution to the radiation pattern 110A to 110C according to the relative power and the relative phase of the antenna-unit-specific antenna signals 318A, 318B. The establishment of the radiation pattern 110A to 110B may also be referred to as beam forming.

The feeding circuit 302 controls the characteristics of the radiation pattern 110A to 110C by adjusting the relative amplitude of the antenna-unit-specific antenna signals 318A, 318B.

The feeding circuit 302 receives the at least one radio frequency signal 208 from the radio frequency unit 204 of the base station 200, converts the radio frequency signal 208 into the antenna-unit-specific antenna signals 318A, 318B and feeds the antenna-unit-specific antenna signals 318A, 318B into the antenna units 320A, 320B.

The feeding circuit 302 comprises an adjustable phase shifter (APS) 308 and an antenna signal amplitude adjuster (ASAA) 306 connected to the adjustable phase shifter 308.

The antenna signal amplitude adjuster 306 adjusts the relative amplitude of the antenna-unit-specific antenna signals 318A, 318B as a function of a phase shift between radio frequency signals 316A, 316B inputted into the antenna signal amplitude adjuster 306.

The functional form of the relative amplitudes may be written as $$\frac{A_1}{A_2} = f(\phi), \tag{1}$$

where $A_1$ and $A_2$ represent the signal amplitudes of the first 318A and the second 318B antenna-unit-specific antenna signal, respectively, while $\phi$ represents the phase shift between the radio frequency signals 316A, 316B inputted into the antenna signal amplitude adjuster 306. The functional dependence of function f on the phase shift $\phi$ depends on the embodiment of the antenna signal amplitude adjuster 306.

In an embodiment of the invention, the antenna signal amplitude adjuster 306 is implemented with a quadrature hybrid circuit, comprising input ports for the radio frequency signals 316A, 316B and output ports for the antenna-unit-specific antenna signals 318A, 318B. The quadrature hybrid circuit introduces a phase shift of $\alpha=\pi/2$ between the antenna-unit-specific antenna signals 318A, 318B. Furthermore, the amplitudes of the antenna-unit-specific antenna signals 318A, 318B equal or almost equal each other when the phase shift $\phi$ between radio frequency signals 316A, 316B reaches $\pi/2$. Correspondingly, the amplitude of one of the two antenna-unit-specific antenna signals 318A, 318B is at its minimum when the phase shift $\phi$ reaches zero.

The antenna signal amplitude adjuster 306 may be implemented with microstrip structures, which typically comprise a conductive pattern formed on a printed board equipped with a uniform ground potential. The conductive pattern guides the propagation of radio frequency waves associated with the radio frequency signals 316A, 316B in the antenna signal amplitude adjuster 306.

The amplitude adjuster may also be implemented with branch-line quadrature hybrids, ring quadrature hybrids and other type of hybrids realized with microstrip, stripline or coaxial techniques.

The adjustable phase shifter 308 introduces the adjustable phase shift $\phi$ between the radio frequency signals 316A, 316B inputted into the antenna signal amplitude adjuster 306. In an embodiment of the invention, the phase of a first radio frequency signal 316A is left unaltered, while the phase of a second radio frequency signal 316B is changed.

The adjustable phase shifter 308 may be based on line stretch technique, where electrical lengths of propagation lines are altered so as to cause a delay in the propagation of the second radio frequency signal 316B. The stretch technique is known to one skilled in the art and will not be described in greater detail in this context.

In an embodiment of the invention, the adjustable phase shifter 308 provides a continuously adjustable phase shift $\phi$.

In an embodiment of the invention, the adjustable phase shifter 308 is an electrically controlled analogue phase shifter, which may be realized with varactor diodes that change capacitance with voltage, or non-linear dielectric, such as barium strontium titanate, or ferro-electric materials such as yttrium iron garnet.

In an embodiment of the invention, the adjustable phase shifter 308 is a mechanically-controlled analogue phase shifter, which may be implemented with a mechanically lengthened transmission line also referred to as a trombone line.

A hybrid circuit with adjustable sliding shorts or adjustable capacitors in its output ports may also be used as an analogue phase shifter. Any type of active phase shifters may also be used as an adjustable phase shifter 308.

The adjustment of the phase shift $\phi$ may be controlled by a phase shift controller 322, which receives a control command 324A provided, for example, by the digital domain of the base station 202. The control command 324A includes an instruction on the amount of phase shift to be applied to the second radio frequency signal 316B.

In an embodiment of the invention, the control command 324A is generated in the core network 106 by a network operator, for example.

The phase shift controller 322 generates a control signal 324B on the basis of the control command 324A. The control signal 324B is fed into the mechanical and/or electrical control device, which realizes the adjustment of the phase difference $\phi$.

In an embodiment of the invention, the feeding circuit 302 further comprises a first power divider 310 connected to the adjustable phase shifter 308. The first power divider 310 divides the radio frequency signal 208 inputted into the first power divider 310 into at least two radio frequency signals 316A, 314, which have equal powers. The power divider may be implemented with a three-port divider, such as a Wilkinson power divider. The structure and operation of power dividers are known to a person skilled in the art and will not be described in greater detail in this context.

In an embodiment of the invention, the feed circuit 302 and the antenna array 304 are integrated into a same housing, thus resulting in a single unit that may be installed in the top of a mast of the base station 102.

Figure 4:
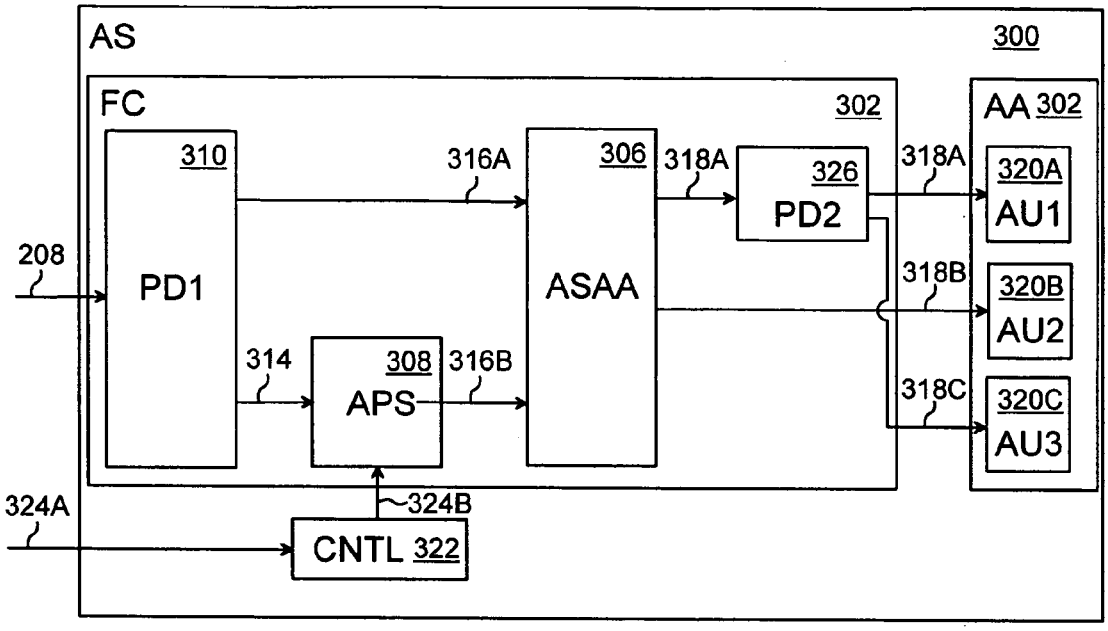
FIG. 4 shows an example of a structure of a feeding circuit according to an embodiment of the invention.

With reference to FIG. 4, the feed circuit 302 may further comprise a second power divider 326 connected to the output of the antenna signal amplitude adjuster 306. In this case, the antenna array 304 comprises at least three antenna units (AU1, AU2, AU3) 320A, 320B, 320C, each associated with an antenna-unit-specific antenna signal 318A, 318B, 318C, respectively. The second power divider 326 divides the power of an antenna-unit-specific antenna signal 318A so as to produce one further antenna-unit-specific antenna signal 318C. A similar power division may be applied to the second antenna-unit-specific antenna signal 318B in order to produce a fourth antenna-unit-specific antenna signal for a fourth antenna unit not shown in FIG. 4.

Figure 5A:
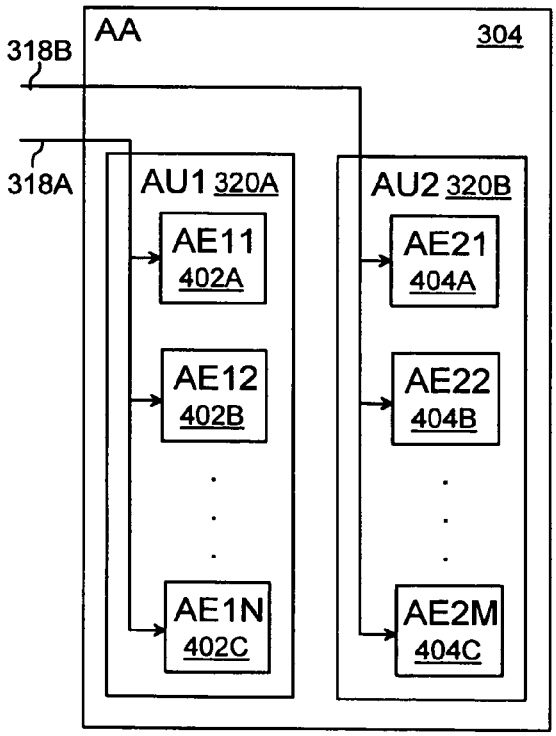
FIG. 5A shows a first example of the structure of an antenna array according to an embodiment of the invention.

With reference to FIG. 5A, the antenna units 320A, 320B of the antenna array 304 may comprise a plurality of antenna elements 402A to 402C, 404A to 404C, where the antenna elements in each antenna unit 320A, 320B are provided with an antenna-unit-specific antenna signal 318A, 318B. Phase shifters not shown in FIG. 5A may be applied between the antenna elements in order to generate radiation patterns.

In an embodiment of the invention, the antenna elements 402A to 404C are configured into a linear configuration. In the linear configuration, antenna elements 402A to 404C within one antenna unit 320A, 320B are located linearly with the order of $\lambda/2$ spacing between successive antenna elements 402A to 404C, where $\lambda$ is the length of the electromagnetic wave associated with the radiation pattern 110A to 110B.

Figure 5B:
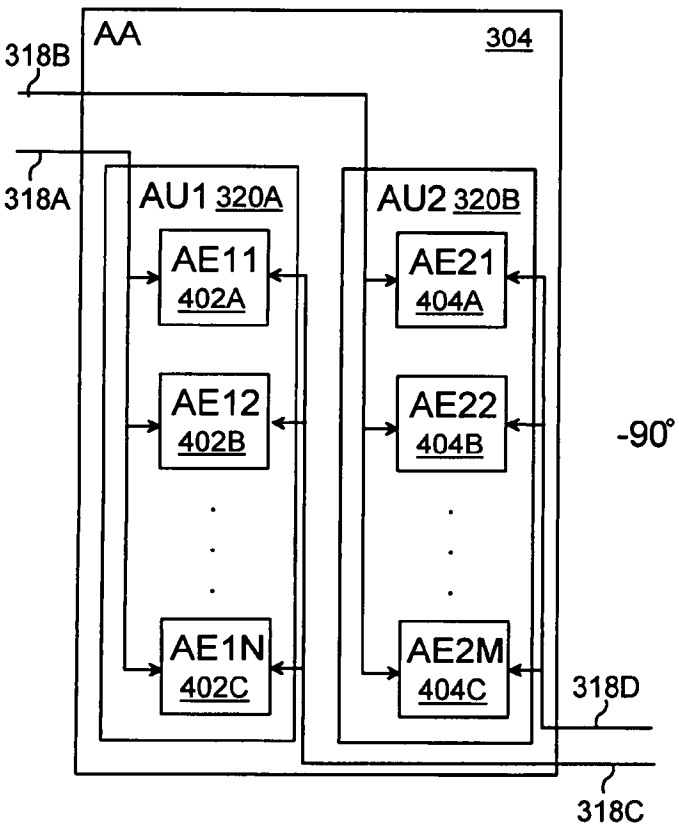
FIG. 5B shows a second example of a structure of an antenna array according to an embodiment of the invention.

With reference to FIG. 5B, in an embodiment of the invention, the antenna elements 402A to 404C in antenna units 320A and 320B may comprise two input ports for two different polarization components. In this case, two feed circuits 302 are then used to produce antenna specific signals 318A, 318B, 318C and 318D for both polarizations as presented in FIG. 5B.

The linear configuration may be a vertical configuration or a horizontal configuration. In the vertical configuration, vertical characteristics of the radiation pattern 110A to 110C are defined by the phase difference between the antenna elements 402A to 404C within one antenna unit 320A, 320B and may be static. In the horizontal direction, the different antenna units 320A, 320B radiate at adjusted power, thus being capable of changing the radiation pattern in the horizontal direction. In an embodiment of the invention, the width of the radiation pattern is controlled.

In the horizontal configuration, horizontal characteristics of the radiation pattern 110A to 110C are defined by the phase difference between the antenna elements 402A to 404C within one antenna unit 320A, 320B and may be static. In this case, the adjustment of the relative amplitude of the antenna-unit-specific antenna signals 318A, 318B result in the adjustment of the radiation pattern 110A to 110C in the vertical direction. In an embodiment of the invention, the height of the radiation pattern is controlled.

Figure 6:
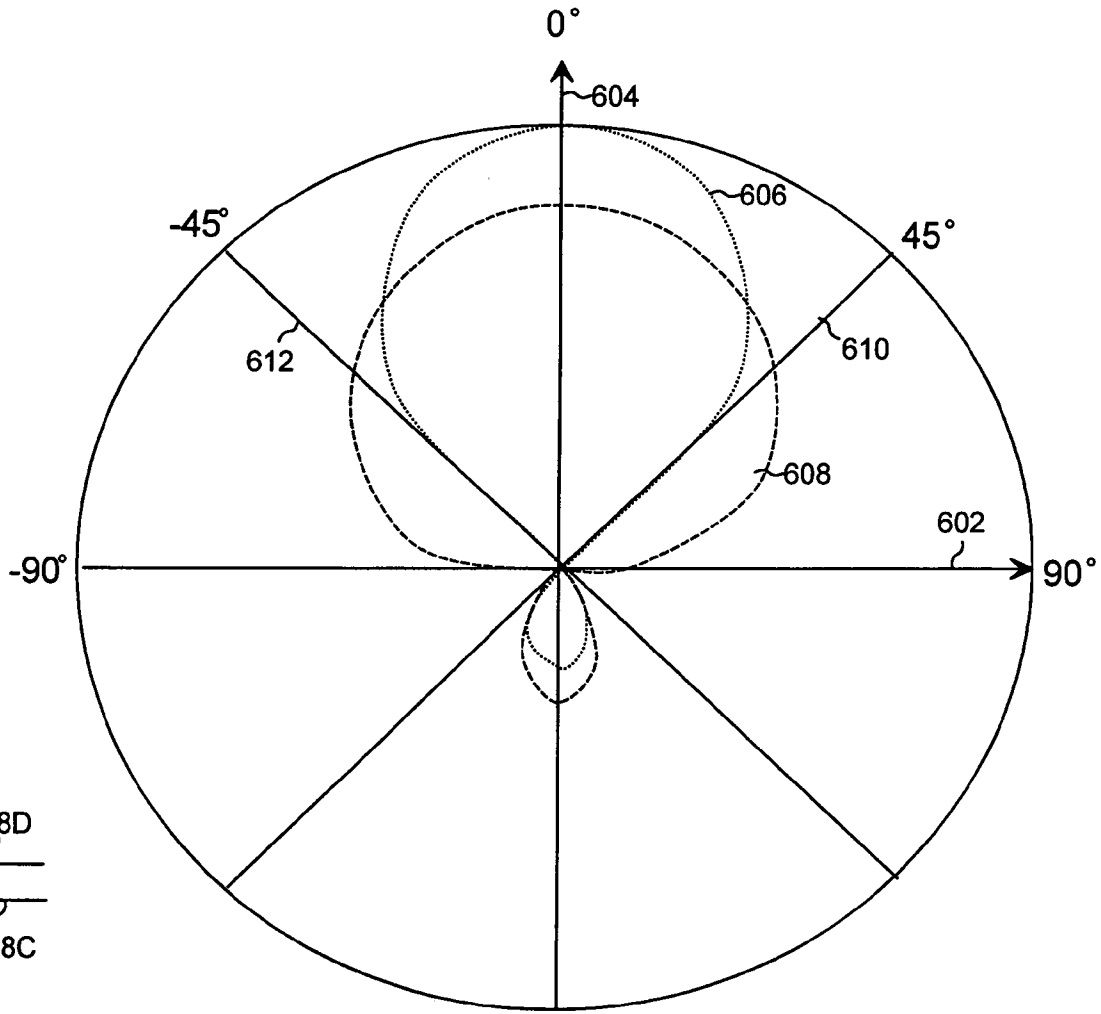
FIG. 6 shows examples of radiation patterns according to embodiments of the invention.

With reference to FIG. 6, a plot is shown to illustrate the effect of the phase shift $\phi$ on the shape of a radiation pattern when two antenna units 320A, 320B with linear vertical configuration are applied. A horizontal axis 602 and a vertical axis 604 show the power of the radiation field in arbitrary units, such as decibel units. The horizontal axis 602 further illustrates a radiation angle of 90 degrees with respect to the normal of the antenna array 304. The vertical axis further illustrates the direction of the normal of the antenna array 304. Furthermore, radiation angles 45 and −45 degrees are illustrated with lines 610 and 612, respectively.

A first radiation pattern 606 plotted with a dotted line represents a case where the phase difference $\phi$ has been adjusted close to zero. In this case, the first radiation pattern 606 is relatively narrow and provides well-located coverage for the base station 102.

A second radiation pattern 608 plotted with a dashed line represents a case where the phase shift $\phi$ has been adjusted close to −90 degrees. The phase shift results in a deformation in the radiation pattern, thus providing approximately a double coverage for the base station 102.

Figure 7:
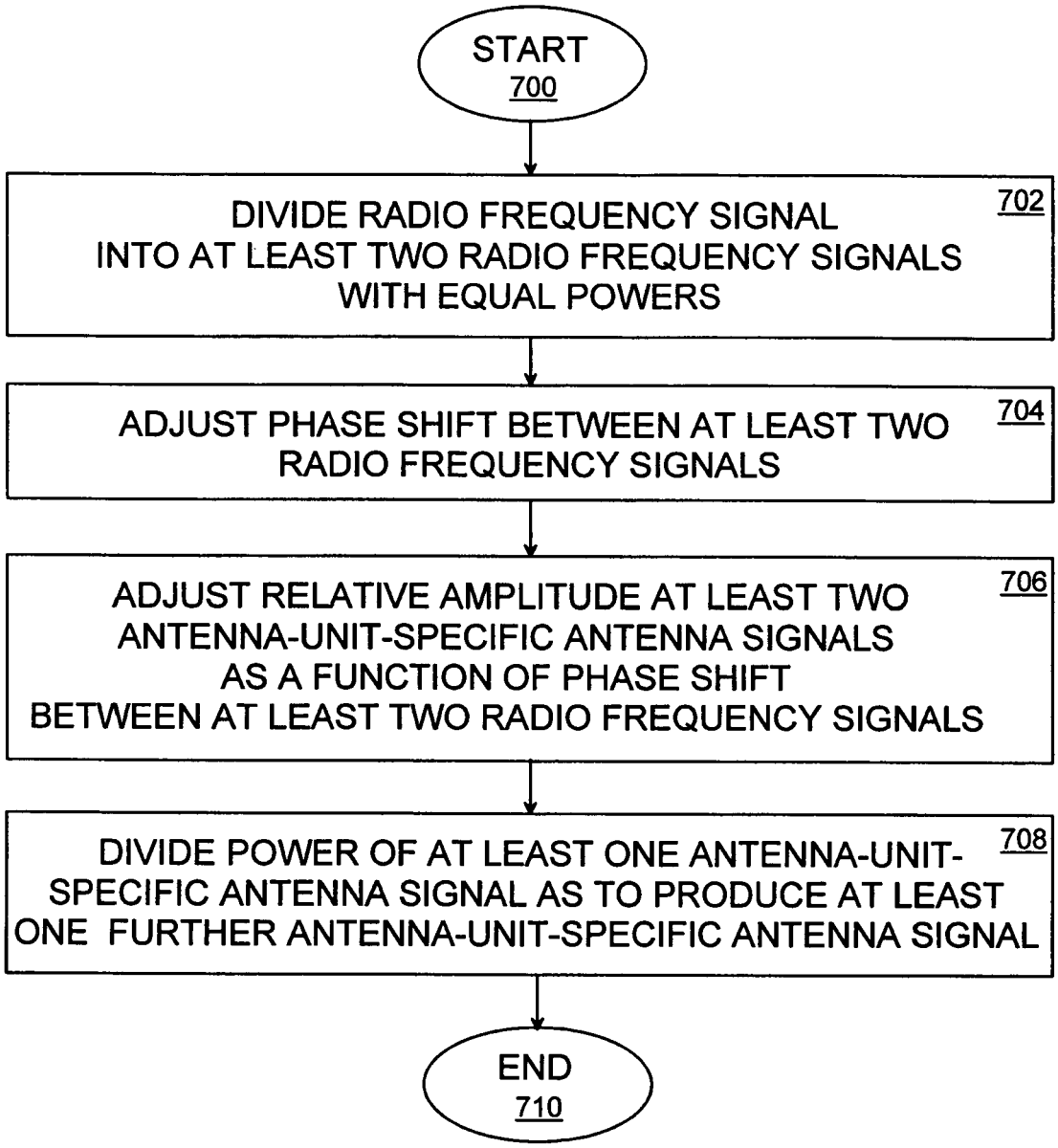
FIG. 7 illustrates methodology according to an embodiment of the invention.

With reference to FIG. 7, a methodology according to embodiments of the invention is illustrated with a flow chart presentation.

In 700, the method starts.

In 702, according to an embodiment, a radio frequency signal 208 is divided into at least two radio frequency signals 316A, 316B with equal powers.

In 704, the phase shift between at least two radio frequency signals 316A, 316B is adjusted.

In 706, the relative amplitude of at least two antenna-unit-specific antenna signals 318A, 318B is adjusted as a function of the phase shift between the at least two radio frequency signals 316A, 316B.

In 708, according to an embodiment, the power of at least one antenna-unit-specific antenna signal 318A, 318B is divided so as to produce at least one further antenna-unit-specific antenna signal 318C.

In 710, the method ends.

Even though the invention has been described above with reference to an example according to the accompanying drawings, it is clear that the invention is not restricted thereto but it can be modified in several ways within the scope of the appended claims.

The invention claimed is:

1. A circuit comprising:

an antenna signal amplitude adjuster for adjusting a relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster, the circuit being configured to control a characteristic of a radiation pattern provided by an antenna array of a base station of a wireless telecommunications system, where the antenna array comprises at least two independent antenna units, each antenna unit being associated with an antenna-unit-specific antenna signal.

2. The circuit of claim 1, further comprising a first power divider for dividing a radio frequency signal inputted into the first power divider into the at least two radio frequency signals with equal powers, at least one radio frequency signal being fed into the adjustable phase shifter and at least one radio frequency signal being fed into the antenna signal amplitude adjuster.

3. The circuit of claim 1, wherein the antenna array comprises at least three antenna units, each antenna unit being associated with an antenna-unit-specific antenna signal, wherein the circuit further comprises at least one second power divider for dividing the power of the at least one antenna-unit-specific antenna signal so as to produce at least one further antenna-unit-specific antenna signal.

4. The circuit of claim 1, wherein each antenna unit includes a plurality of antenna elements in a linear configuration.

5. The circuit of claim 1, wherein the antenna signal amplitude adjuster and the adjustable phase shifter are configured to control at least one characteristic of radiation patterns, the characteristics being selected from a group comprising a width of the radiation pattern and a height of the radiation pattern.

6. The circuit of claim 1, wherein the circuit and the antenna array are integrated into a same housing.

7. An antenna system of a base station of a wireless telecommunications system, comprising:

an antenna array for providing a radiation pattern, the antenna array comprising at least two independent antenna units, each antenna unit being associated with an antenna-unit-specific antenna signal;

an antenna signal amplitude adjuster for adjusting relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster.

8. The antenna system of claim 7, the antenna system further comprising a first power divider for dividing a radio frequency signal inputted into the first power divider into at least two radio frequency signals with equal powers, at least one radio frequency signal being fed into the adjustable phase shifter and at least one radio frequency signal being fed into the antenna signal amplitude adjuster.

9. The antenna system of claim 7, wherein the antenna array comprises at least three antenna units, each antenna unit being associated with an antenna-unit-specific antenna signal wherein the antenna system further comprises at least one second power divider for dividing the power of the at least one antenna-unit-specific antenna signal so as to produce at least one further antenna-unit-specific antenna signal.

10. The antenna system of claim 7, wherein each antenna unit includes a plurality of antenna elements in a linear configuration.

11. The antenna system of claim 7, wherein the antenna signal amplitude adjuster and the adjustable phase shifter are configured to control at least one characteristic of radiation patterns, the characteristics being selected from a group comprising a width of the radiation pattern and a height of the radiation pattern.

12. The antenna system of claim 7, wherein the antenna signal amplitude adjuster, the adjustable phase shifter and the antenna array are integrated into a same housing.

13. A base station of a wireless telecommunications system, comprising:

an antenna array for providing a radiation pattern, the antenna array comprising at least two independent antenna units, each antenna unit being associated with an antenna-unit-specific antenna signal;

an antenna signal amplitude adjuster for adjusting relative amplitude of at least two antenna-unit-specific antenna signals as a function of a phase shift between at least two radio frequency signals inputted into the antenna signal amplitude adjuster; and an adjustable phase shifter for adjusting the phase shift between the at least two radio frequency signals inputted into the antenna signal amplitude adjuster.

14. The base station of claim 13, the base station further comprising a first power divider for dividing a radio frequency signal inputted into the power divider into the at least two radio frequency signals with equal powers, at least one radio frequency signal being fed into the adjustable phase shifter and at least one radio frequency signal being fed into the antenna signal amplitude adjuster.

15. The base station of claim 13, wherein the antenna array comprises at least three antenna units, each antenna unit being associated with an antenna-unit-specific antenna signal, wherein the base station further comprises at least one second power divider for dividing the power of the at least one antenna-unit-specific antenna signal so as to produce at least one further antenna-unit-specific antenna signal.

16. The base station of claim 13, wherein each antenna unit includes a plurality of antenna elements in a linear configuration.

17. The base station of claim 13, wherein the antenna signal amplitude adjuster and the adjustable phase shifter are configured to control at least one characteristic of radiation pattern, the characteristics being selected from a group comprising a width of the radiation pattern and a height of the radiation pattern.

18. The base station of claim 13, wherein the antenna signal amplitude adjuster, the adjustable phase shifter and the antenna array are integrated into a same housing.

19. A method comprising:

adjusting a phase shift between at least two radio frequency signals; and adjusting a relative amplitude of at least two antenna-unit-specific antenna signals as a function of the phase shift between the at least two radio frequency signals, thereby controlling a characteristic of a radiation pattern provided by an antenna array of a base station of a wireless telecommunications system, where the antenna array comprises at least two independent antenna units, each antenna unit being associated with an antenna-unit-specific antenna signal.

20. The method of claim 19, further comprising dividing radio frequency signal into the at least two radio frequency signals with equal powers.

21. The method of claim 19, wherein the antenna array comprises at least three antenna units, each antenna unit being associated with an antenna-unit-specific antenna signal, the method further comprising dividing the power of the at least one antenna-unit-specific antenna signal so as to produce at least one further antenna-unit-specific antenna signal.

22. The method of claim 19, wherein each antenna unit includes a plurality of antenna elements in a linear configuration.

23. The method of claim 19, wherein the characteristic of the radiation pattern being controlled is selected from a group comprising a width of the radiation pattern and a height of the radiation pattern.

24. A circuit comprising:

amplitude adjusting means for adjusting a relative amplitude of at least two antenna-unit-specific antenna signals as a function of a phase shift between at least two radio frequency signals inputted into the antenna signal amplitude adjuster; and phase adjusting means for adjusting the phase shift between the at least two radio frequency signals inputted into the amplitude adjusting means, the circuit being configured to control a characteristic of a radiation pattern provided by an antenna array of a base station of a wireless telecommunications system, where the antenna array comprises at least two independent antenna units, each antenna unit being associated with an antenna-unit-specific antenna signal.

25. The circuit of claim 24, the circuit further comprising a first power dividing means for dividing a radio frequency signal inputted into the first power dividing means into the at least two radio frequency signals with equal powers, at least one radio frequency signal being fed into the adjustable phase shifter and at least one radio frequency signal being fed into the antenna signal amplitude adjuster.

* * * * *